US009786981B2

(12) United States Patent
Mahanfar et al.

(10) Patent No.: US 9,786,981 B2
(45) Date of Patent: Oct. 10, 2017

(54) ANTENNA FOR ELECTRONIC DEVICE

(71) Applicant: MICROSOFT TECHNOLOGY LICENSING, LLC, Redmond, WA (US)

(72) Inventors: Alireza Mahanfar, Bellevue, WA (US); Gregorio Tellez, Redmond, WA (US); Benjamin Shewan, Redmond, WA (US); Javier R. De Luis, Kirkland, WA (US); Gregory Kim Justice, Redmond, WA (US); Vinod L. Hingorani, Redmond, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 319 days.

(21) Appl. No.: 14/332,163

(22) Filed: Jul. 15, 2014

(65) Prior Publication Data

US 2016/0020506 A1 Jan. 21, 2016

(51) Int. Cl.

| | |
|---|---|
| ***H01Q 1/50*** | (2006.01) |
| ***H01Q 1/27*** | (2006.01) |
| ***G04G 21/04*** | (2013.01) |
| ***H01Q 9/42*** | (2006.01) |

(52) U.S. Cl.

CPC ..... *H01Q 1/273* (2013.01); *G04G 21/04* (2013.01); *H01Q 1/50* (2013.01); *H01Q 9/42* (2013.01)

(58) Field of Classification Search

CPC ..... H01C 1/243; H01C 1/24; H01C 1/273; H01C 1/50; H01C 9/42; G04G 21/04

See application file for complete search history.

(56) References Cited

U.S. PATENT DOCUMENTS

| | | | | |
|---|---|---|---|---|
| 5,696,518 | A | 12/1997 | Itoh et al. | |
| 5,699,319 | A | 12/1997 | Skrivervik | |
| 5,886,669 | A * | 3/1999 | Kita | H01Q 1/273 343/700 MS |
| 5,926,144 | A | 7/1999 | Bolanos et al. | |
| 6,914,564 | B2 | 7/2005 | Barras et al. | |
| 7,379,712 | B2 | 5/2008 | Saarnimo | |
| 7,398,151 | B1 | 7/2008 | Burrell et al. | |

(Continued)

FOREIGN PATENT DOCUMENTS

| | | |
|---|---|---|
| EP | 2498336 A2 | 9/2012 |
| EP | 2541681 A1 | 1/2013 |
| GB | 2463536 A | 3/2010 |

OTHER PUBLICATIONS

Fingas, Jon, "TomTom's new GPS watches track your heart rate without a chest strap (update: US pricing)", http://www.engadget.com/2014/04/03/tomtom-cardio-gps-watches/, Apr. 3, 2014, 10 pages.

(Continued)

*Primary Examiner* — Graham Smith
*Assistant Examiner* — Noel Maldonado
(74) *Attorney, Agent, or Firm* — Alleman Hall Creasman & Tuttle LLP

(57) ABSTRACT

Embodiments are disclosed for an antenna system comprising an over-resonant antenna conductor and a radio receiver electrically coupled to the over-resonant antenna conductor. The antenna system further comprises a capacitor electrically coupled to the over-resonant antenna conductor and sized to match the antenna conductor to a selected frequency.

20 Claims, 10 Drawing Sheets

(56) References Cited

U.S. PATENT DOCUMENTS

| | | | | |
|---|---|---|---|---|
| 2007/0229372 | A1* | 10/2007 | Desclos | H01Q 1/243 343/702 |
| 2011/0098583 | A1 | 4/2011 | Pandia et al. | |
| 2013/0050032 | A1 | 2/2013 | Shiu et al. | |

OTHER PUBLICATIONS

Goode, Lauren, "Samsung's New Gear Fit Needs to Work on the "Fit" Part", http://recode.net/2014/04/08/samsungs-new-gear-fit-needs-to-work-on-the-fit-part/, Apr. 8, 2014, 10 pages.

"Samsung Gear Fit, Gear 2 and Gear 2 Neo go on sale worldwide", NDTV Gadgets, http://gadgets.ndtv.com/others/news/samsung-gear-fit-gear-2-and-gear-2-neo-go-on-sale-worldwide-507220, Apr. 11, 2014, 3 pages.

Poeter, Damon, "Meet Simband, Samsung's Next-Gen Health Tracker", http://www.pcmag.com/article2/0,2817,2458663,00.asp, May 28, 2014, 5 pages.

Salonen, et al., "A Small Planar Inverted-F Antenna for Wearable Applications", In Proceedings of Third International Symposium on Wearable Computers, Oct. 18, 1999, 6 pages.

ISA European Patent Office, International Search Report and Written Opinion issued in Application No. PCT/US2015/039633, dated Oct. 8, 2015, WIPO, 11 pages.

* cited by examiner

ANTENNA FOR ELECTRONIC DEVICE

BACKGROUND

Electronic devices, including portable electronic devices, may communicate with other electronic devices via one or more antennas.

DETAILED DESCRIPTION

Figure 1A:
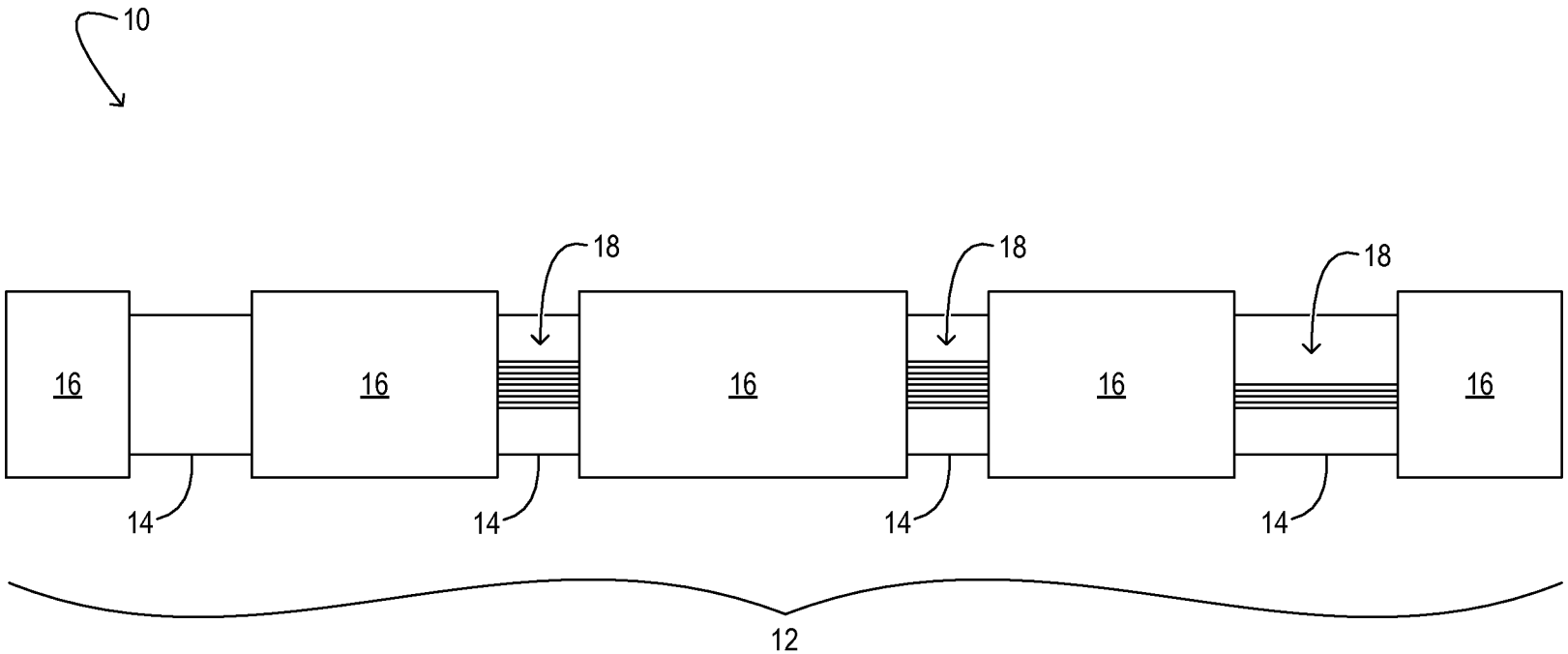
FIG. 1A schematically shows aspects of an example wearable electronic device.

The amount of space that is available to an antenna system (e.g., conductors, cabling, radio transmitter/receiver electronics, etc.) may affect the signal transmission/reception strength and fidelity of the antennas system. The radiation properties of antennas utilized in portable devices may also be affected by other electronics in proximity to the antennas, electromagnetically dissipative human body tissue, and nearby metallic objects.

The present disclosure relates to antennas that are configured to mitigate the interference sources described above. For example, the antennas may be configured to transmit and/or receive data over a frequency associated with GPS, Bluetooth, WiFi, cellular frequencies associated with 3G and LTE cellular specifications, and/or any other suitable communication frequency range. An antenna may be configured (e.g., based on a length, conductive material, position, and/or other parameter) to resonate at a native frequency (e.g., an unmatched frequency) above an associated target frequency (e.g., a matched and/or operating frequency) and then matched via a capacitive matching network connected to the antenna in order to increase performance in a small volume. For example, the small volume may be located in a band or an enclosure of a wearable electronic device or in a cavity of an implantable device. Locating the antenna outside of a display housing (e.g., away from the display electronics) may improve transmission/reception line of sight while isolating the antenna from noise generated by the display or digital processing electronics. A cable connecting the antenna to a radio receiver/transmitter located near the display electronics may be grounded at a pass-through in an outer region of the display housing in order to further reduce noise in the data signal passing to/from the antenna.

Aspects of this disclosure will now be described by example and with reference to the drawing figures listed above. Components and other elements that may be substantially the same in one or more figures are identified coordinately and described with minimal repetition. It will be noted, however, that elements identified coordinately may also differ to some degree.

Figure 1B:
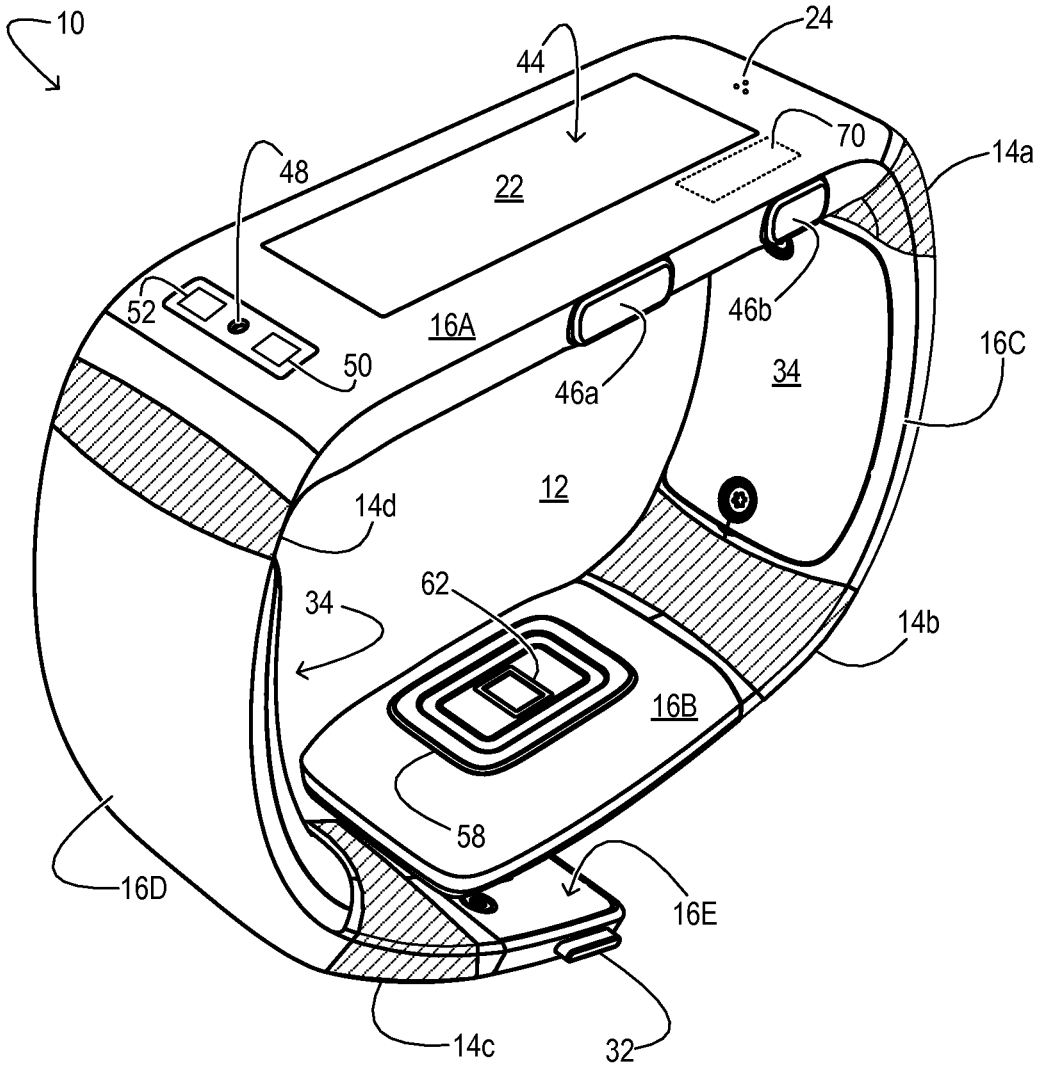
FIGS. 1B and 1C show additional aspects of an example wearable electronic device.
Figure 1C:
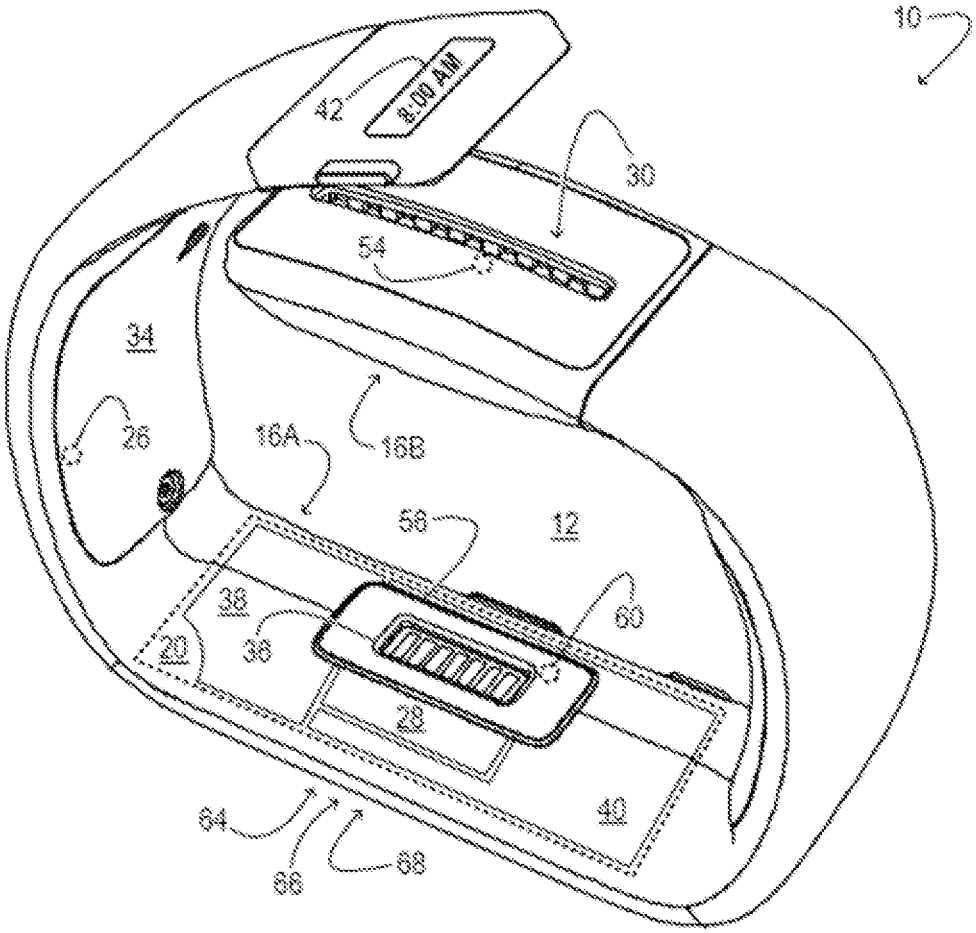

FIGS. 1A-C show aspects of a wearable electronic device 10 in one, non-limiting configuration. The illustrated device takes the form of a composite band 12, which may be worn around a wrist. Composite band 12 includes flexible segments 14 and rigid segments 16. The terms 'flexible' and 'rigid' are to be understood in relation to each other, not necessarily in an absolute sense. Moreover, a flexible segment may be relatively flexible with respect to one bending mode and/or stretching mode, while being relatively inflexible with respect to other bending modes, and to twisting modes. A flexible segment may be elastomeric in some examples. In these and other examples, a flexible segment may include a hinge and may rely on the hinge for flexibility, at least in part.

The illustrated configuration includes four flexible segments 14 linking five rigid segments 16. Other configurations may include more or fewer flexible segments, and more or fewer rigid segments. In some implementations, a flexible segment is coupled between pairs of adjacent rigid segments.

Various functional components, sensors, energy-storage cells, circuits, connectors, or other elements of wearable electronic device 10 may be distributed among multiple rigid segments 16. Accordingly, as shown schematically in FIG. 1A, one or more of the intervening flexible segments 14 may include a course of electrical conductors 18 running between adjacent rigid segments, inside or through the intervening flexible segment. The course of electrical conductors may include conductors that distribute power, receive or transmit a communication signal, or carry a control or sensory signal from one functional component of the device to another. In some implementations, a course of electrical conductors may be provided in the form of a flexible printed-circuit assembly (FPCA, vide infra), which also may physically support various electronic and/or logic components.

In one implementation, a closure mechanism enables facile attachment and separation of the ends of composite band 12, so that the band can be closed into a loop and worn on the wrist. In other implementations, the device may be fabricated as a continuous loop resilient enough to be pulled over the hand and still conform to the wrist. Alternatively, the device may have an open bracelet form factor in which ends of the band are not fastened to one another. In still other implementations, wearable electronic devices of a more elongate band shape may be worn around the user's bicep, waist, chest, ankle, leg, head, or other body part. Accordingly, the wearable electronic devices here contemplated include eye glasses, a head band, an arm-band, an ankle band, a chest strap, or even an implantable device to be implanted in tissue.

As shown in FIGS. 1B and 1C, wearable electronic device 10 includes various functional components: a compute system 20, display 22, loudspeaker 24, haptic motor 26, communication suite 28, and various sensors. In the illustrated implementation, the functional components are integrated into rigid segments 16—viz., display-carrier module 16A, pillow 16B, battery compartments 16C and 16D, and buckle 16E. This tactic protects the functional components from physical stress, from excess heat and humidity, and from exposure to water and substances found on the skin, such as sweat, lotions, salves, and the like.

In the illustrated conformation of wearable electronic device 10, one end of composite band 12 overlaps the other end. A buckle 16E is arranged at the overlapping end of the composite band, and a receiving slot 30 is arranged at the overlapped end. As shown in greater detail herein, the receiving slot has a concealed rack feature, and the buckle includes a set of pawls to engage the rack feature. The buckle snaps into the receiving slot and slides forward or backward for proper adjustment. When the buckle is pushed into the slot at an appropriate angle, the pawls ratchet into tighter fitting set points. When release buttons 32 are squeezed simultaneously, the pawls release from the rack feature, allowing the composite band to be loosened or removed.

The functional components of wearable electronic device 10 draw power from one or more energy-storage cells 34. A battery—e.g., a lithium ion battery—is one type of energy-storage cell suitable for this purpose. Examples of alternative energy-storage cells include super- and ultra-capacitors. A typical energy storage cell is a rigid structure of a size that scales with storage capacity. To provide adequate storage capacity with minimal rigid bulk, a plurality of discrete separated energy storage cells may be used. These may be arranged in battery compartments 16C and 16D, or in any of the rigid segments 16 of composite band 12. Electrical connections between the energy storage cells and the functional components are routed through flexible segments 14. In some implementations, the energy storage cells have a curved shape to fit comfortably around the wearer's wrist, or other body part.

In general, energy-storage cells 34 may be replaceable and/or rechargeable. In some examples, recharge power may be provided through a universal serial bus (USB) port 36, which includes a magnetic latch to releasably secure a complementary USB connector. In other examples, the energy storage cells may be recharged by wireless inductive or ambient-light charging. In still other examples, the wearable electronic device may include electro-mechanical componentry to recharge the energy storage cells from the user's adventitious or purposeful body motion. More specifically, the energy-storage cells may be charged by an electromechanical generator integrated into wearable electronic device 10. The generator may be actuated by a mechanical armature that moves when the user is moving.

In wearable electronic device 10, compute system 20 is housed in display-carrier module 16A and situated below display 22. The compute system is operatively coupled to display 22, loudspeaker 24, communication suite 28, and to the various sensors. The compute system includes a data-storage machine 38 to hold data and instructions, and a logic machine 40 to execute the instructions.

Display 22 may be any suitable type of display, such as a thin, low-power light emitting diode (LED) array or a liquid-crystal display (LCD) array. Quantum-dot display technology may also be used. Suitable LED arrays include organic LED (OLED) or active matrix OLED arrays, among others. An LCD array may be actively backlit. However, some types of LCD arrays—e.g., a liquid crystal on silicon, LCOS array—may be front-lit via ambient light. Although the drawings show a substantially flat display surface, this aspect is by no means necessary, for curved display surfaces may also be used. In some use scenarios, wearable electronic device 10 may be worn with display 22 on the front of the wearer's wrist, like a conventional wristwatch. However, positioning the display on the back of the wrist may provide greater privacy and ease of touch input. To accommodate use scenarios in which the device is worn with the display on the back of the wrist, an auxiliary display module 42 may be included on the rigid segment opposite display-carrier module 16A. The auxiliary display module may show the time of day, for example.

Communication suite 28 may include any appropriate wired or wireless communications componentry. In FIGS. 1B and 1C, the communications suite includes USB port 36, which may be used for exchanging data between wearable electronic device 10 and other computer systems, as well as providing recharge power. The communication suite may further include two-way Bluetooth, Wi-Fi, cellular, near-field communication, and/or other radios. In some implementations, the communication suite may include an additional transceiver for optical, line-of-sight (e.g., infrared) communication.

In wearable electronic device 10, touch-screen sensor 44 is coupled to display 22 and configured to receive touch input from the user. Accordingly, the display may be a touch-sensor display in some implementations. In general, the touch sensor may be resistive, capacitive, or optically based. Push-button sensors (e.g., microswitches) may be used to detect the state of push buttons 46*a* and 46*b*, which may include rockers. Input from the push-button sensors may be used to enact a home-key or on-off feature, control audio volume, microphone, etc.

FIGS. 1B and 1C show various other sensors of wearable electronic device 10. Such sensors include microphone 48, visible-light sensor 50, ultraviolet sensor 52, and ambient-temperature sensor 54. The microphone provides input to compute system 20 that may be used to measure the ambient sound level or receive voice commands from the user. Input from the visible-light sensor, ultraviolet sensor, and ambient-temperature sensor may be used to assess aspects of the user's environment. In particular, the visible-light sensor can be used to sense the overall lighting level, while the ultraviolet sensor senses whether the device is situated indoors or outdoors. In some scenarios, output from the visible light sensor may be used to automatically adjust the brightness level of display 22, or to improve the accuracy of the ultraviolet sensor. In the illustrated configuration, the ambient-temperature sensor takes the form a thermistor, which is arranged behind a metallic enclosure of pillow 16B, next to receiving slot 30. This location provides a direct conductive path to the ambient air, while protecting the sensor from moisture and other environmental effects.

FIGS. 1B and 1C show a pair of contact sensors—charging contact sensor 56 arranged on display-carrier module 16A, and pillow contact sensor 58 arranged on pillow 16B. Each contact sensor contacts the wearer's skin when wearable electronic device 10 is worn. The contact sensors may include independent or cooperating sensor elements, to provide a plurality of sensory functions. For example, the contact sensors may provide an electrical resistance and/or capacitance sensory function responsive to the electrical resistance and/or capacitance of the wearer's skin. To this end, the two contact sensors may be configured as a galvanic skin-response sensor, for example. Compute system 20 may use the sensory input from the contact sensors to assess whether, or how tightly, the device is being worn, for example. In the illustrated configuration, the separation between the two contact sensors provides a relatively long electrical path length, for more accurate measurement of skin resistance. In some examples, a contact sensor may also provide measurement of the wearer's skin temperature. In the illustrated configuration, a skin temperature sensor 60 in the form a thermistor is integrated into charging contact sensor 56, which provides direct thermal conductive path to the skin. Output from ambient-temperature sensor 54 and skin temperature sensor 60 may be applied differentially to estimate of the heat flux from the wearer's body. This metric can be used to improve the accuracy of pedometer-based calorie counting, for example. In addition to the contact-based skin sensors described above, various types of non-contact skin sensors may also be included.

Arranged inside pillow contact sensor 58 in the illustrated configuration is an optical pulse-rate sensor 62. The optical pulse-rate sensor may include a narrow-band (e.g., green) LED emitter and matched photodiode to detect pulsating blood flow through the capillaries of the skin, and thereby provide a measurement of the wearer's pulse rate. In some implementations, the optical pulse-rate sensor may also be configured to sense the wearer's blood pressure. In the illustrated configuration, optical pulse-rate sensor 62 and display 22 are arranged on opposite sides of the device as worn. The pulse-rate sensor alternatively could be positioned directly behind the display for ease of engineering. In some implementations, however, a better reading is obtained when the sensor is separated from the display.

Wearable electronic device 10 may also include motion sensing componentry, such as an accelerometer 64, gyroscope 66, and magnetometer 68. The accelerometer and gyroscope may furnish inertial data along three orthogonal axes as well as rotational data about the three axes, for a combined six degrees of freedom. This sensory data can be used to provide a pedometer/calorie-counting function, for example. Data from the accelerometer and gyroscope may be combined with geomagnetic data from the magnetometer to further define the inertial and rotational data in terms of geographic orientation.

Wearable electronic device 10 may also include a global positioning system (GPS) receiver 70 for determining the wearer's geographic location and/or velocity. In some configurations, the antenna of the GPS receiver may be relatively flexible and extend into flexible segment 14*a*. In the configuration of FIGS. 1B and 1C, the GPS receiver is far removed from optical pulse-rate sensor 62 to reduce interference from the optical pulse-rate sensor. More generally, various functional components of the wearable electronic device—display 22, compute system 20, GPS receiver 70, USB port 36, microphone 48, visible-light sensor 50, ultraviolet sensor 52, and skin temperature sensor 60—may be located in the same rigid segment for ease of engineering, but the optical pulse-rate sensor may be located elsewhere to reduce interference on the other functional components.

Figure 2B:
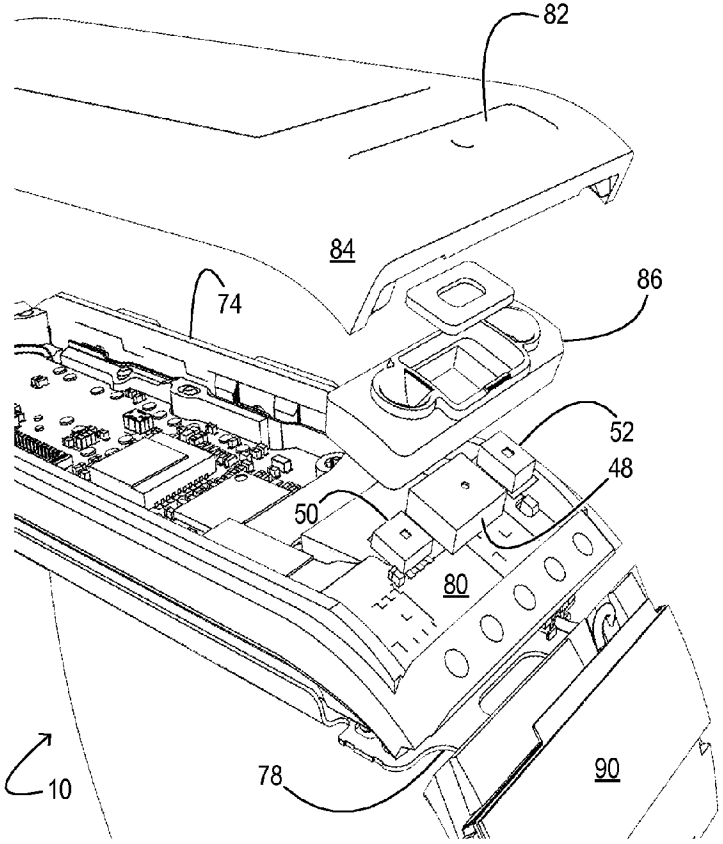
FIGS. 2A and 2B are exploded views of an example wearable electronic device.
Figure 2A:
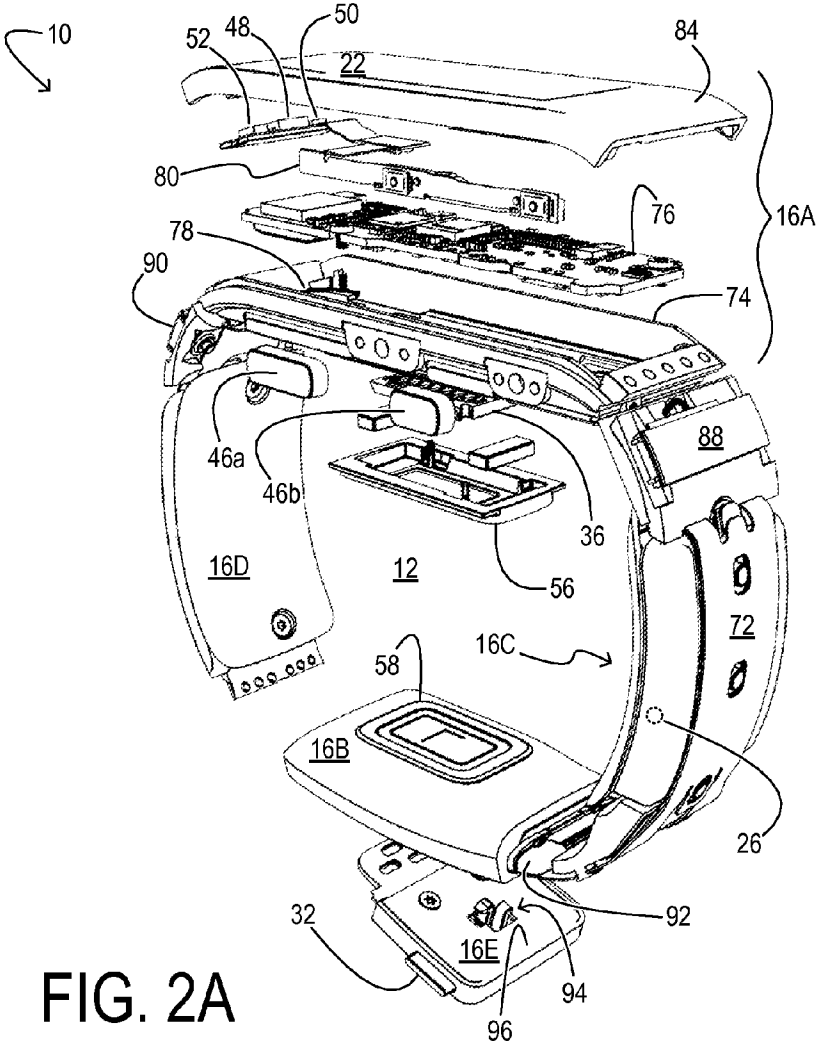

FIGS. 2A and 2B show aspects of the internal structure of wearable electronic device 10 in one, non-limiting configuration. In particular, FIG. 2A shows semi-flexible armature 72 and display carrier module 74. The semi-flexible armature is the backbone of composite band 12, which supports display-carrier module 16A, pillow 16B, and battery compartments 16C and 16D. The semi-flexible armature may be a very thin band of steel, in one implementation. The display carrier may be a metal frame overmolded with plastic. It may be attached to the semi-flexible armature with mechanical fasteners. In one implementation, these fasteners are molded-in rivet features, but screws or other fasteners may be used instead. The display carrier provides suitable stiffness in display-carrier module 16A to protect display 22 from bending or twisting moments that could dislodge or break it. In the illustrated configuration, the display carrier also surrounds the main printed circuit assembly (PCA) 76, where compute system 20 is located, and provides mounting features for the main PCA.

In some implementations, wearable electronic device 10 includes a main flexible FPCA 78, which runs from pillow 16B all the way to battery compartment 16D. In the illustrated configuration, the main FPCA is located beneath semi-flexible armature 72 and assembled onto integral features of the display carrier. In the configuration of FIG. 2A, push buttons 46*a* and 46*b* penetrate one side of display carrier module 74. These push buttons are assembled directly into the display carrier and are sealed by o-rings. The push buttons act against microswitches mounted to sensor FPCA 80.

Display-carrier module 16A also encloses sensor FPCA 80. At one end of rigid segment 16A, and located on the sensor FPCA, are visible-light sensor 50, ultraviolet sensor 52, and microphone 48. A polymethylmethacrylate window 82 is insert molded into a glass insert-molded (GIM) bezel 84 of display-carrier module 16A, over these three sensors. The window has a hole for the microphone and is printed with IR transparent ink on the inside covering except over the ultraviolet sensor. A water repellent gasket 86 is positioned over the microphone, and a thermoplastic elastomer (TPE) boot surrounds all three components. The purpose of the boot is to acoustically seal the microphone and make the area more cosmetically appealing when viewed from the outside.

As noted above, display carrier module 74 may be overmolded with plastic. This overmolding does several things. First, the overmolding provides a surface that the device TPE overmolding will bond to chemically. Second, it creates a shut-off surface, so that when the device is overmolded with TPE, the TPE will not ingress into the display carrier compartment. Finally, the PC overmolding creates a glue land for attaching the upper portion of display-carrier module 16A.

The charging contacts of USB port 36 are overmolded into a plastic substrate and reflow soldered to main FPCA 78. The main FPCA may be attached to the inside surface of semi-flexible armature 72. In the illustrated configuration, charging contact sensor 56 is frame-shaped and surrounds the charging contacts. It is attached to the semi-flexible armature directly under display carrier module 74—e.g., with rivet features. Skin temperature sensor 60 (not shown in FIG. 2A or 2B) is attached to the main FPCA under the charging contact-sensor frame, and thermal conduction is maintained from the frame to the sensor with thermally conductive putty.

FIGS. 2A and 2B also show a Bluetooth antenna 88 and a GPS antenna 90 that are coupled to their respective radios via shielded connections. Each antenna is attached to semi-flexible armature 72 on either side of display carrier module 74. The semi-flexible armature may serve as a ground plane for the antennas in some implementations. Formed as FPCAs and attached to plastic antenna substrates with adhesive, the Bluetooth and GPS antennas extend into flexible segments 14*a* and 14*d*, respectively. In other examples, the antennas may be patterned onto substrates of different materials such as ceramic or a semiconductor. The plastic antenna substrates maintain about a 2-millimeter spacing between the semi-flexible armature and the antennae in some examples. The antenna substrates may be attached to semi-flexible armature 72 with heat staked posts. TPE filler parts are attached around the antenna substrates. These TPE filler parts may prevent TPE defects like 'sink' when the device is overmolded with TPE.

Shown also in FIG. 2A are metallic battery compartments 16C and 16D, attached to the inside surface of semi-flexible armature 72, such that main FPCA 78 is sandwiched between the battery compartments and the semi-flexible armature. The battery compartments have an overmolded rim that serves the same functions as the plastic overmolding previously described for display carrier module 74. The battery compartments may be attached with integral rivet features molded-in. In the illustrated configuration, battery compartment 16C also encloses haptic motor 26.

Shown also in FIG. 2A, a bulkhead 92 is arranged at and welded to one end of semi-flexible armature 72. This feature is shown in greater detail in the exploded view of FIG. 3. The bulkhead provides an attachment point for pillow contact sensor 58. The other end of the semi-flexible armature extends through battery compartment 16D, where flexible strap 14*c* is attached. The strap is omitted from FIG. 2 for clarity, but is shown in FIGS. 1B and 1C. In one example, the strap is attached with rivets formed integrally in the battery compartment. In another embodiment, a plastic end part of the strap is molded-in as part of the battery compartment overmolding process.

In the configuration of FIG. 2A, buckle 16E is attached to the other end of strap 14*c*. The buckle includes two opposing, spring-loaded pawls 94 constrained to move laterally in a sheet-metal spring box 96. The pawls and spring box are concealed by the buckle housing and cover, which also have attachment features for the strap. The two release buttons 32 protrude from opposite sides of the buckle housing. When these buttons are depressed simultaneously, they release the pawls from the track of receiving slot 30 (as shown in FIG. 1C).

Figure 3:
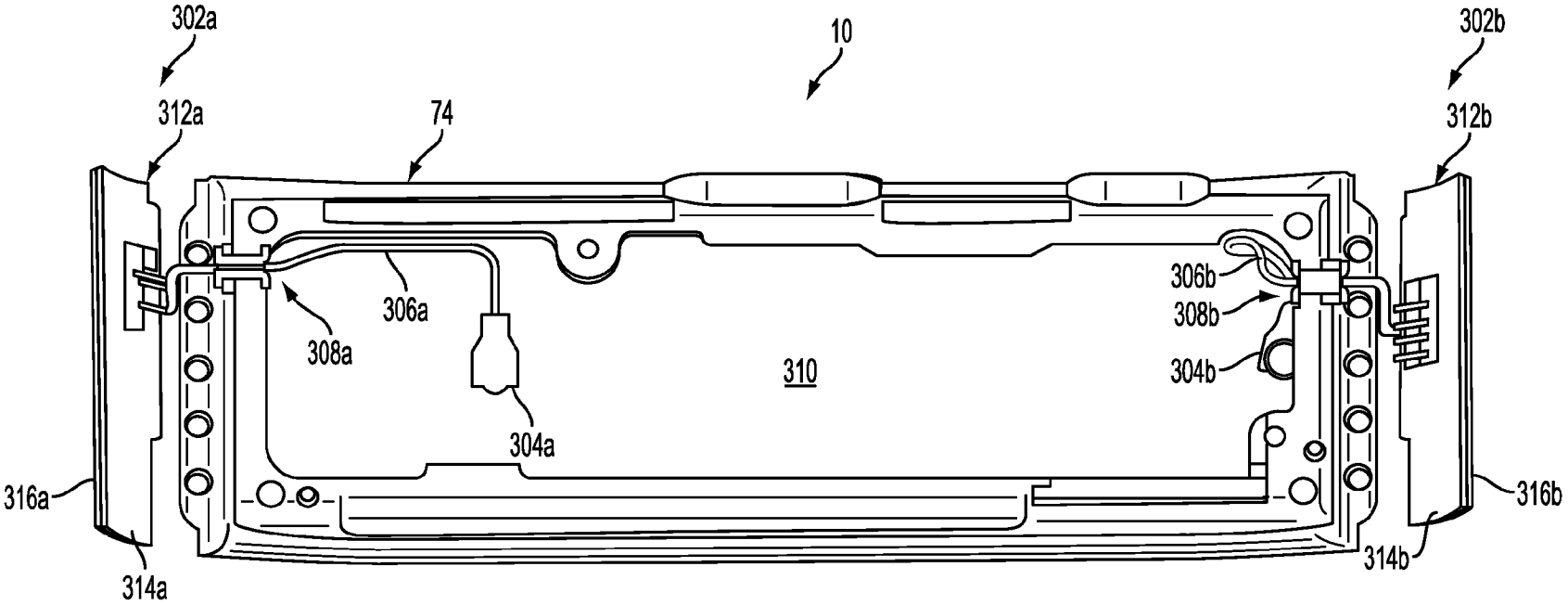
FIG. 3 is an interior view of an example display structure and antennas for a wearable electronic device.

FIG. 3 is an interior view of a portion of wearable device 10 including display-carrier module 74 and antennas 302*a* and 302*b*. Radio receivers and/or transmitters for the antennas may be disposed within a conductive enclosure formed by display-carrier module 74. For example, radio receiver and/or transmitter 304*a* may transmit and/or receive data from antenna 302*a* via coaxial cable 306*a*. Coaxial cable 306*a* may traverse a pass-through structure 308*a*, described in more detail below with respect to FIG. 6.

Pass-through structure 308*a* may be formed of conductive material pressed into outer walls of the display-carrier module 74 in order to enable the coaxial cable to be grounded at a point between the radio receiver and/or transmitter 304*a* (e.g., grounded at substrate 310) and the antenna 302*a*. The coaxial cable 306*a* may be grounded at antenna 302*a* via connection to a radiofrequency ground disposed on a rear side 314*a* of an antenna substrate 312*a*. Grounding at multiple points along the coaxial cable, including the location at which the cable passes from the conductive enclosure to the antenna, may further isolate the antenna conductor from disruptive/interfering electromagnetic activity. The antenna conductor may be disposed on a front side 316*a* of the antenna substrate, as described in more detail with respect to FIGS. 5A and 5B.

A second antenna 302*b* and associated components may be disposed on an opposite side of the display-carrier module from the first antenna 302*a*. Components labelled with a same base reference numeral may perform similarly to those described above. For example, a second coaxial cable 306*b* may connect a second radio transmitter/receiver 304*b* to antenna 302*b*. The second coaxial cable may traverse a second pass-through structure 308*b* and a second antenna substrate 312*b* may have a rear side 314*b* and a front side 316*b*. The antennas may be configured to communicate via different communication frequencies and/or protocols. For example, antenna 302*a* may be configured to receive and/or transmit Global Positioning System (GPS) signaling, while antenna 302*b* may be configured to communicate via a Bluetooth connection to another compute system. It is to be understood that the above-described arrangement is non-limiting and any suitable arrangement of antennas may be utilized to communicate via any suitable communication frequency or protocol.

Figure 4:
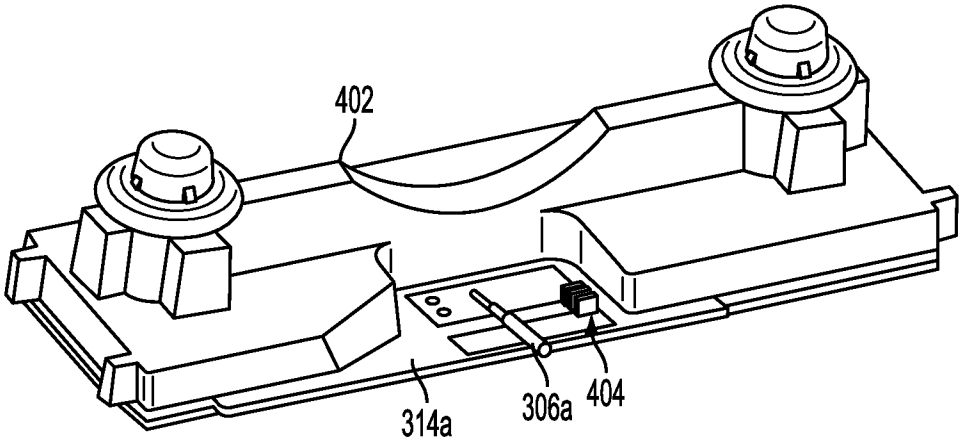
FIG. 4 shows a rear side of an example antenna.

FIG. 4 shows a rear side 314*a* of antenna 302*a* and an antenna carrier 402. It is to be understood that the illustration in FIG. 4 may also correspond to antenna 302*b* of FIG. 3 and the associated elements in antenna 302*b*. Antenna carrier 402 may be configured to mount antenna 302*a* to the display-carrier module 74 and/or a portion of the wrist band (e.g., main flexible FPCA 78 of FIG. 2B) and/or otherwise secure antenna 302*a* within a wearable electronic device. Antenna carrier 402 may be composed of and/or include non-conductive material.

Figure 5A:
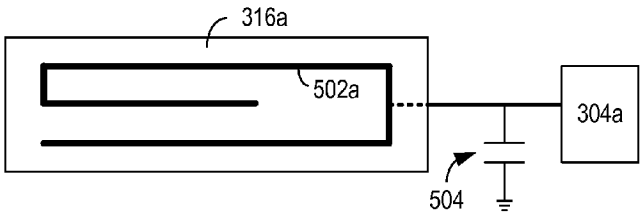
FIGS. 5A and 5B show examples of over- and under-resonant antenna conductors.
Figure 5B:
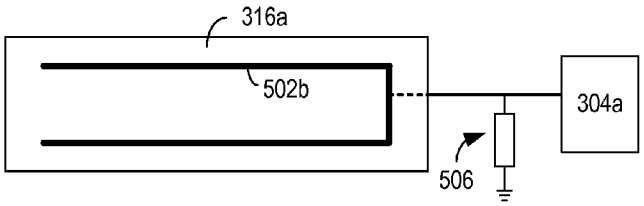

As described above, an antenna conductor may be configured such that in an unmatched condition, the antenna falls into one of two states. The first of these states may be described as under-resonant and describes a condition where at a particular (e.g., target) frequency the antenna impedance has some imaginary component and has not yet become purely real. The second of these states may be described as over-resonant and describes a condition where at the particular (e.g., target) frequency, the antenna impedance has some imaginary component and has surpassed the point where it was purely real. Modification of the antenna conductor geometry may determine in which of these two states and/or conditions the antenna is classified. In some examples, an antenna in the under-resonant state has a total conductor length that is less than the total conductor length of an antenna in the over-resonant state. Regardless of the initial state of the antenna, the resonant frequency after matching will correspond to a selected target frequency (e.g., an operating frequency at which a radio receiver and/or transmitter 304*a*/304*b* is configured to communicate). Turning briefly to FIGS. 5A and 5B, examples of over- and under-resonant antenna conductors 502*a* and 502*b* are illustrated. Over-resonant antenna conductor 502*a* may comprise a conductive material disposed as a trace on a substrate (e.g., a front side 316*a* of antenna 302*a* and/or front side 316*b* of antenna 302*b*). For example, a selected target frequency at which radio receiver and/or transmitter 304*a* is configured to communicate may be in a range of 1560 MHz-1605 MHz for GPS communication or a range of 2400 MHz-2482 MHz for Bluetooth communication. Accordingly, in a matched condition, the over-resonant antenna may be configured to resonate at a frequency in one of the above-described ranges, depending upon the operational frequency of the transmitter/receiver connected to the over-resonant antenna.

In order to match the over-resonant antenna conductor 502*a* to a selected target frequency of the radio receiver/transmitter 304*a*, a capacitive matching circuit 504 may be connected between the antenna conductor and ground. A first terminal of a capacitor of the capacitive matching circuit may be connected to the antenna conductor (e.g., between the antenna conductor and an associated radio receiver/transmitter) and a second terminal of the capacitor may be connected to ground (e.g., an antenna ground disposed on an antenna substrate). A capacitor may additionally or alternatively be provided in printed form by overlapping an area of two conductive traces located in different layers (without providing contact between the traces and/or layers). Other techniques may be utilized to provide a capacitive matching circuit, including but not limited to inter-digital capacitors, in-line gap, and other suitable printed techniques. FIG. 5B illustrates an example under-resonant antenna conductors 502*b* disposed on a front side 316*a* of antenna 302*a*. For matching under-resonant antenna conductor 502*b*, an inductive matching circuit 506

(e.g., including an inductor connected between the antenna conductor and ground) may be connected between the antenna conductor and ground. An inductive matching circuit may additionally or alternatively be provided by utilizing a thin conductive trace between antenna and ground. The dimensions of this trace determines the amount of inductance. While an under-resonant antenna conductor may be shorter in length, an over-resonant antenna may be provided on a similarly-sized substrate by forming the antenna in an inverted-L or meandered configuration, as illustrated in FIG. 5A.

Returning to FIG. 4, a surface-mounted capacitor 404 may be utilized to match the over-resonant antenna to a selected target frequency. The capacitor 404 may be sized (e.g., have a selected capacitance) to match the antenna conductor to the selected target frequency as described above.

Figure 6:
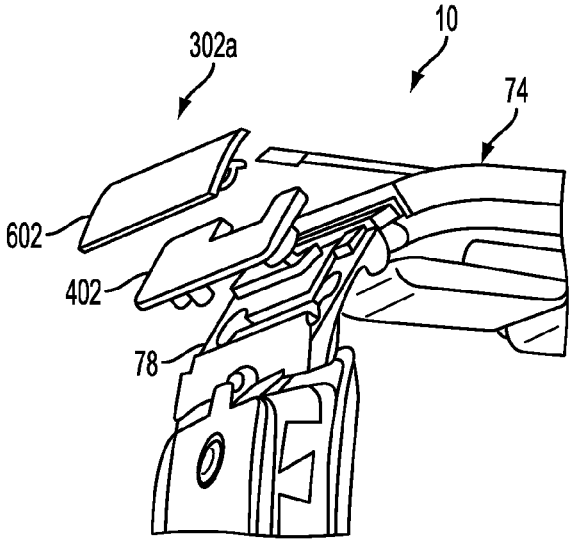
FIG. 6 is an exploded view of an example antenna system included in a wearable electronic device.

FIG. 6 is an exploded view of an example antenna system included in wearable electronic device 10 of FIG. 3. As illustrated, antenna 302*a* is positioned on a side of display-carrier module 74. It is to be understood that the illustration in FIG. 5 may also correspond to antenna 302*b* of FIG. 3 and the associated elements in antenna 302*b*. Antenna 302*a* may be surrounded by two stacks of dielectric material 602 and mounted to antenna carrier 402. Antenna carrier 402 may then be mounted to main flexible FPCA 78 (e.g., via a press-fit connection or other suitable securing mechanism). In this way, the antenna may be positioned in flexible portions of a wrist band of wearable electronic device 10 toward display side of the wearable device, thereby increasing a line of sight of the antenna to communicating devices.

Figure 7:
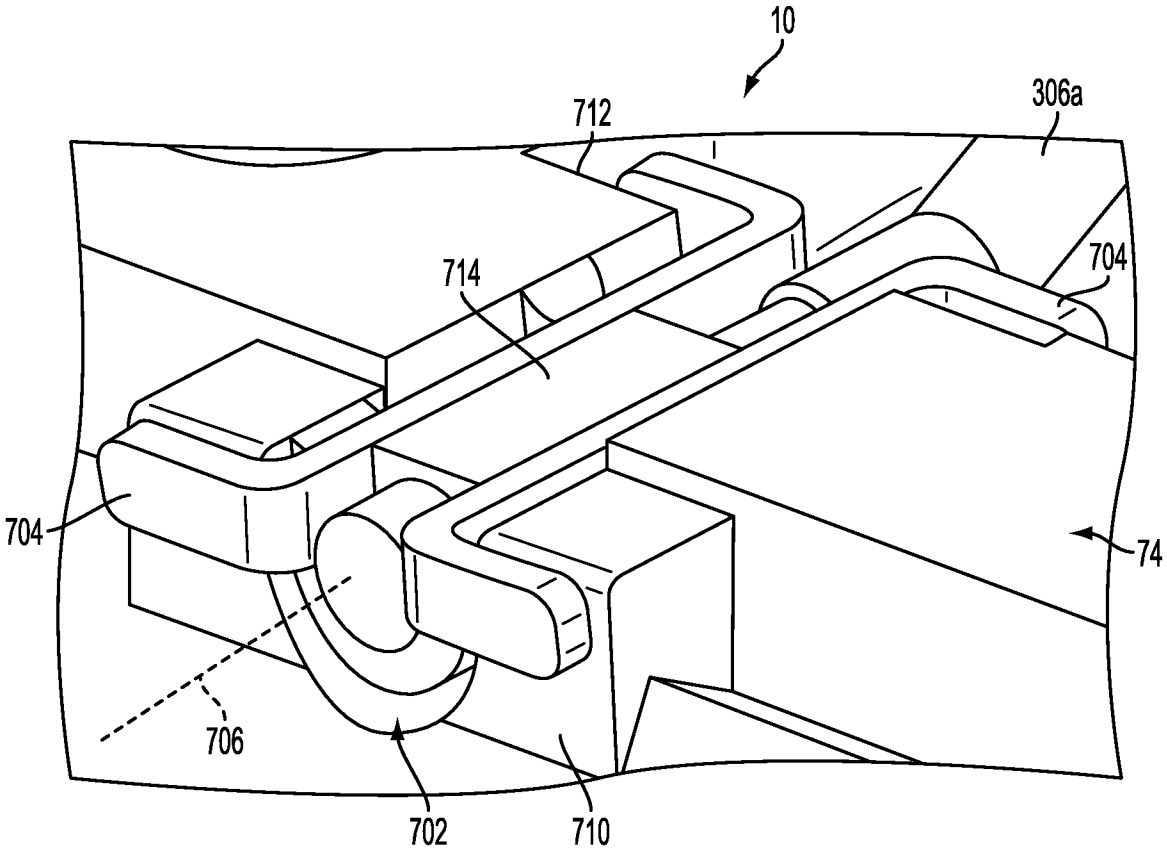
FIG. 7 shows an isometric view of an example cable pass-through for a wearable electronic device.
Figure 8:
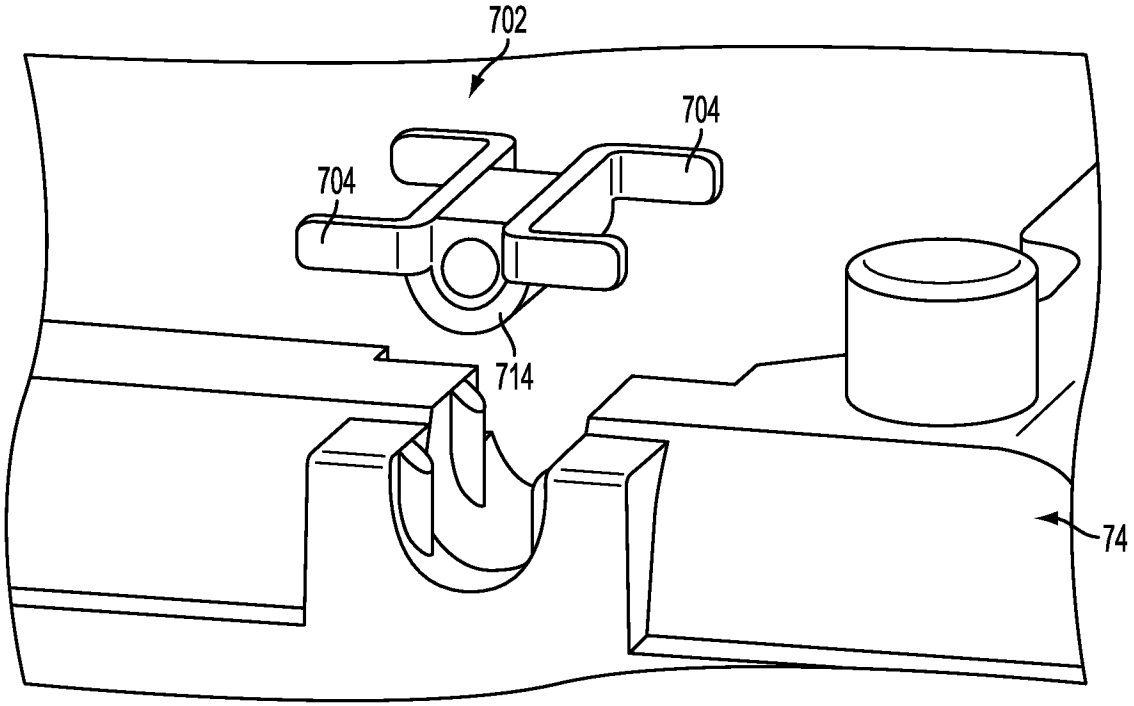
FIG. 8 shows an exploded view of an example cable pass-through and display-carrier module for a wearable electronic device.

FIGS. 7 and 8 illustrate an example cable pass-through structure. FIG. 7 shows an isometric view of a cable pass-through structure 702 for wearable electronic device 10 and FIG. 8 shows an exploded view of the pass-through structure 702 and associated display-carrier module 74. As described above, in order to pass data from a radio receiver/transmitter housed within a conductive enclosure (e.g., forming a grounded Faraday cage) to an antenna outside of the enclosure, a coaxial cable 306*a* may be utilized. While the coaxial cable may be grounded at the antenna end (e.g., via a ground connection included on a printed circuit board on which the antenna conductor is disposed) and at the receiver/transmitter end (e.g., via a ground connection included on a printed circuit board to which the radio receiver/transmitter is connected), additional grounding may provide further protection from interference. Accordingly, pass-through structure 702 may be formed of electrically conductive material pressed into (and thus electrically coupled to) a wall of display-carrier module 74. In this way, pass-through structure 702 may provide an additional connection to ground (e.g., via the housing of display-carrier module 74) at the location at which the coaxial cable 306*a* leaves the Faraday cage formed by display-carrier module 74.

As illustrated, pass-through structure 702 may include a pair of mirror-symmetric brackets 704 having an axis of symmetry along a longitudinal axis 706 of the coaxial cable 306*a*. Brackets 704 may be configured to secure the pass-through structure to the display-carrier module by abutting outer surface 708 and inner surface 710 of a wall 712 of the display-carrier module. A central block 714 of pass-through structure 702 may have a flat top surface, an arched bottom surface, and a hollow central region through which the coaxial cable 306*a* may pass.

The example antenna systems described above mitigate sources of antenna interferences including other electronic devices in proximity to the antennas, electromagnetically dissipative human body tissue, and metallic objects coupled to the antennas. For example, an over-resonant antenna that is matched to a selected target frequency via a capacitive matching circuit may increase performance of the antenna in a small volume compared to antennas that are under-resonant. The position of the example antenna systems (e.g., outside of a display housing) may increase line of sight visibility while isolating the antenna from noise generated by the display electronics. Grounding a coaxial cable connecting the antenna conductor to an associated transmitter/receiver at a pass-through in an outer region of the display housing may further reduce noise in the data signal passing to/from the antenna. Accordingly, the above-described features may enable a small form factor antenna to be utilized in a wearable electronic device without sacrificing antenna performance.

It will be understood that the configurations and approaches described herein are exemplary in nature, and that these specific implementations or examples are not to be taken in a limiting sense, because numerous variations are feasible. The specific routines or methods described herein may represent one or more processing strategies. As such, various acts shown or described may be performed in the sequence shown or described, in other sequences, in parallel, or omitted.

The subject matter of this disclosure includes all novel and non-obvious combinations and sub-combinations of the various processes, systems and configurations, and other features, functions, acts, and/or properties disclosed herein, as well as any and all equivalents thereof.

The invention claimed is:

1. A communication system of an electronic device to be worn on human skin, the communication system comprising:

a radio receiver arranged within an electrically conductive enclosure and configured to receive a communication signal at a predetermined target frequency;

electrically coupled to the radio receiver, an antenna conductor arranged outside of the electrically conductive enclosure and configured geometrically for resonance at an unmatched frequency above the predetermined target frequency, the antenna conductor being folded into multiple parallel portions; and a shunting capacitor electrically coupled to the antenna conductor, the shunting capacitor being of such capacitance as to bring the antenna conductor into resonance at the predetermined target frequency.

2. The communication system of claim 1, wherein the antenna conductor includes an electrically conductive trace disposed on a substrate.

3. The communication system of claim 2, wherein the electrically conductive trace comprises an inverted-L shape to form an inverted-L antenna conductor.

4. The communication system of claim 2, wherein the substrate is surrounded by two stacks of dielectric material.

5. The communication system of claim 1, wherein the antenna conductor is connected to the radio receiver via a coaxial cable.

6. The communication system of claim 5, wherein the coaxial cable is configured to traverse a pass-through structure pressed into an opening in an outer wall of the electrically conductive enclosure.

7. The communication system of claim 6, wherein the coaxial cable is grounded at the pass-through structure.

8. The communication system of claim 1, wherein the target frequency is selected from a range of 1560 MHz to 1605 MHz, to communicate via GPS.

9. The communication system of claim 1, wherein the target frequency is selected from a range of 2400 MHz to 2482 MHz, to communicate via Bluetooth.

10. A wearable electronic device to be worn on human skin, the electronic device comprising:

a display-carrier module forming an electrically conductive enclosure housing a compute system and a display device;

a flexible wrist band coupled to the display-carrier module;

a communication system including a radio receiver arranged within the electrically conductive enclosure and configured to receive a communication signal at a predetermined target frequency;

electrically coupled to the radio receiver, an antenna conductor arranged outside of the electrically conductive enclosure at flexible portions of the flexible wrist band and configured geometrically for resonance at an unmatched frequency above the predetermined target frequency, the antenna conductor being folded into multiple parallel portions; and a shunting capacitor electrically coupled to the antenna conductor, the shunting capacitor being of such capacitance as to bring the antenna conductor into resonance at the predetermined target frequency.

11. The electronic device of claim 10, wherein the antenna conductor includes an electrically conductive trace disposed on a substrate.

12. The electronic device of claim 11, wherein the electrically conductive trace comprises an inverted-L shape to form an inverted-L antenna conductor.

13. The electronic device of claim 10, wherein the antenna conductor is connected to the radio receiver via a coaxial cable.

14. The electronic device of claim 13, wherein the coaxial cable is configured to traverse a pass-through structure pressed into an opening in an outer wall of the electrically conductive enclosure.

15. The electronic device of claim 14, wherein the coaxial cable is grounded at the pass-through structure and at substrates corresponding to each of the antenna conductor and the radio receiver.

16. The electronic device of claim 10, wherein the antenna conductor comprises a first antenna conductor and the shunting capacitor comprises a first shunting capacitor, the electronic device further comprising a second antenna conductor coupled to a second shunting capacitor.

17. The electronic device of claim 16, wherein the first shunting capacitor is of such capacitance as to match the first antenna conductor to a first target frequency for communicating via GPS and the second shunting capacitor is of such capacitance as to match the second antenna conductor to a second target frequency for communicating via Bluetooth.

18. The electronic device of claim 16, wherein the first and second antenna conductors are disposed on opposite sides of the display device.

19. A communication system of an electronic device to be worn on human skin, the communication system comprising: a radio receiver arranged within an electrically conductive enclosure and configured to receive a communication signal at a predetermined target frequency; electrically coupled to the radio receiver, an antenna conductor arranged outside of the electrically conductive enclosure and configured geometrically for resonance at an unmatched frequency above the predetermined target frequency, the antenna conductor being formed with plural parallel portions on a flexible printed-circuit assembly attached to a metal armature through a plastic antenna substrate, the plastic antenna substrate maintaining a two-millimeter separation between the metal armature and the antenna conductor; and a shunting capacitor electrically coupled to the antenna conductor, the shunting capacitor being of such capacitance as to bring the antenna conductor into resonance at the predetermined target frequency.

20. The communication system of claim 19 wherein the communication signal includes one or more of a Bluetooth, Wifi, GPS, and cellular signal.

* * * * *